US006191708B1

(12) United States Patent
Davidson

(10) Patent No.: US 6,191,708 B1
(45) Date of Patent: Feb. 20, 2001

(54) METHOD AND SYSTEM FOR PROVIDING INFORMATION REGARDING THE LOCATION OF A VEHICLE

(76) Inventor: William E. Davidson, c/o HDIC-Hamel Davidson Int'l Corp. Suite 101, 3626 Shannon Rd., Durham, NC (US) 27707

( * ) Notice: Under 35 U.S.C. 154(b), the term of this patent shall be extended for 0 days.

(21) Appl. No.: 09/534,446

(22) Filed: Mar. 24, 2000

(51) Int. Cl.[7] ..... G08G 1/123
(52) U.S. Cl. ..... 340/994; 701/204; 455/500
(58) Field of Search ..... 340/994, 988; 701/204, 213, 300; 455/99, 39, 500

(56) References Cited

U.S. PATENT DOCUMENTS

| | | | | |
|---|---|---|---|---|
| 3,886,515 | * | 5/1975 | Cottin et al. | 340/994 |
| 4,350,969 | * | 9/1982 | Greer | 340/994 |
| 4,713,661 | * | 12/1987 | Boone et al. | 340/994 |
| 4,791,571 | * | 12/1988 | Takahashi et al. | 701/117 |
| 5,144,301 | * | 9/1992 | Jackson et al. | 340/994 |
| 5,400,020 | | 3/1995 | Jones | 340/994 |
| 5,444,444 | | 8/1995 | Ros | 340/994 |
| 5,483,454 | * | 1/1996 | Lewiner et al. | 701/200 |
| 5,623,260 | | 4/1997 | Jones | 340/994 |
| 5,657,010 | | 8/1997 | Jones | 340/994 |
| 5,668,543 | | 9/1997 | Jones | 340/994 |
| 5,736,940 | * | 4/1998 | Burgener | 340/994 |
| 5,739,774 | * | 4/1998 | Olandesi | 340/994 |
| 5,808,565 | * | 9/1998 | Matta et al. | 340/994 |
| 6,006,159 | * | 12/1999 | Schmier et al. | 701/200 |
| 6,037,881 | * | 3/2000 | Bornhauser et al. | 340/994 |
| 6,097,317 | * | 8/2000 | Lewiner et al. | 340/994 |

* cited by examiner

*Primary Examiner*—Benjamin C. Lee
(74) *Attorney, Agent, or Firm*—Dinesh Agarwal, P.C.

(57) ABSTRACT

A method for providing information regarding a vehicle that follows a route and stops at a stop along the route. The method includes the following steps:

(1) Generating a signal including identification information for the vehicle, (2) Transmitting the signal from a transmitter sub-system on this vehicle, (3) Receiving the signal at a receiver sub-system near the stop on the route; and (4) Processing the signal at the receiver sub-system to identify the vehicle and to estimate a time period to arrive at the stop.

23 Claims, 2 Drawing Sheets

METHOD AND SYSTEM FOR PROVIDING INFORMATION REGARDING THE LOCATION OF A VEHICLE

FIELD OF THE INVENTION

This invention relates in general to an advance notification method and system and more particularly to a method and system for providing information regarding the location of a vehicle.

BACKGROUND OF THE INVENTION

In transport systems, problems may arise due to uncertainty about the whereabouts of a vehicle and when the vehicle will arrive at a given location. Typically, the vehicle will either drop-off or pick-up a person or item at the given location.

This problem can arise with school buses, which pickup and deliver children at their homes or a nearby stop. In the morning, when the children are being picked up, they and their parents will be uncertain regarding the exact arrival time of the bus. Accordingly, the children must be at the stop location waiting for the bus before the bus is expected to arrive. If the bus is late for any reason, the children may be waiting in a cold or deserted area for an extended period of time. If the bus is ahead of schedule, or the children are late arriving at the pick-up spot, the bus may have to wait for the children, thereby delaying the subsequent pick-up of other children further along the route.

Problems may also arise when the bus is delivering the children at the end of the day, due to uncertainty regarding when the bus will arrive at a drop-off location. When parents arrive home, they may be uncertain whether the bus has in fact gone by, and whether or not their children have arrived home from school.

Prior art notification systems have been devised to address the above-noted problems. Generally, these prior art systems involve three-way communication between a bus, a central station, and each drop-off or pick-up location. Specifically, the vehicle first determines its location using, say, an onboard Global Positioning System (G.P.S.). Then, the vehicle communicates its location to a control unit at a centralized location. The control unit then determines the relative position of the bus in the route and notifies a series of receivers, located at or nearby the various pick-up and drop-off points, of the approach of the vehicle.

U.S. Pat. No. 5,400,020 discloses an advance notification system including a vehicle control unit for each bus, as well as a base control unit located in a centralized location. In operation, the vehicle control unit determines the location of the bus using a G.P.S. or other suitable system. The vehicle control unit then transmits this location information to the base control unit, which determines the relative position of the bus in the route from the absolute position determined by the G.P.S. When the bus is a certain predefined distance from a stop for a particular home on the bus route, the base control unit automatically telephones this home to inform the children or their parents that the bus is about to arrive.

While solving some of the above-mentioned problems, this system suffers from a number of disadvantages. The system depends on the centralized control unit, and if this centralized control unit fails, then the entire system will fail. The demands placed on the centralized control unit are considerable—it must keep track of each location to be notified of the approach of the vehicle. As a result, the centralized control unit is complicated and expensive, as is the G.P.S. or other suitable location system mounted on the bus. The system also ties up telephone lines, or, if the telephone line is in use, the message regarding the approach of the vehicle may not get through. Thus, an advance notification system that does not rely on a centralized communication system is desirable.

SUMMARY OF THE INVENTION

An object of one aspect of the present invention is to provide an improved advance notification system.

In accordance with an aspect of the present invention there is provided an advance notification system for providing information regarding a vehicle that follows a route and stops at a vehicle stop along the route. The system comprises a transmitter sub-system for generating and transmitting a signal, and a receiver sub-system for receiving the signal transmitted by the transmitter sub-system. The signal includes identification information for the route. The transmitter sub-system is mounted on the vehicle. The receiver sub-system is located near the vehicle stop and has a data processing means for processing the signal received by the receiver system to identify the route and to estimate a time period for the vehicle to arrive at the vehicle stop.

Preferably, the receiver sub-system includes a plurality of receivers distributed along the route for the vehicle, the route has a plurality of stops and each receiver in the plurality of receivers is operable to receive the signal and is located near an associated vehicle stop in the plurality of vehicle stops. The data processing means includes a plurality of data processing units, each receiver in the plurality of receivers being linked to an associated data processing unit in the plurality of data processing units. For each receiver, the associated data processing unit is operable to process the signal to identify the route and to estimate the time period for the vehicle to reach the associated vehicle stop.

In accordance with another aspect of the present invention, there is provided a method for providing information regarding the vehicle that follows the route and stops at a stop along the route. The method includes the steps of generating a signal including identification for the vehicle, transmitting the signal from a transmitter sub-system on the vehicle, receiving the signal at a receiver sub-system near the stop on the route, and processing the signal at the receiver sub-system to identify the vehicle and to estimate a time period for the vehicle to arrive at the stop.

Preferably, the route has a plurality of stops, the receiver sub-system includes a plurality of receivers distributed along the route for the vehicle, each receiver in the plurality of receivers being located near an associated stop in the plurality of stops, and the step of receiving the signal comprises receiving the signal in each receiver in the plurality of receivers and processing the signal to identify the vehicle and to estimate a time period for the vehicle to arrive at each stop.

BRIEF DESCRIPTION OF THE DRAWINGS

A detailed description of the preferred aspects of the invention is provided herein below with reference to the following drawings, in which.

DETAILED DESCRIPTION OF PREFERRED ASPECTS

Figure 1:
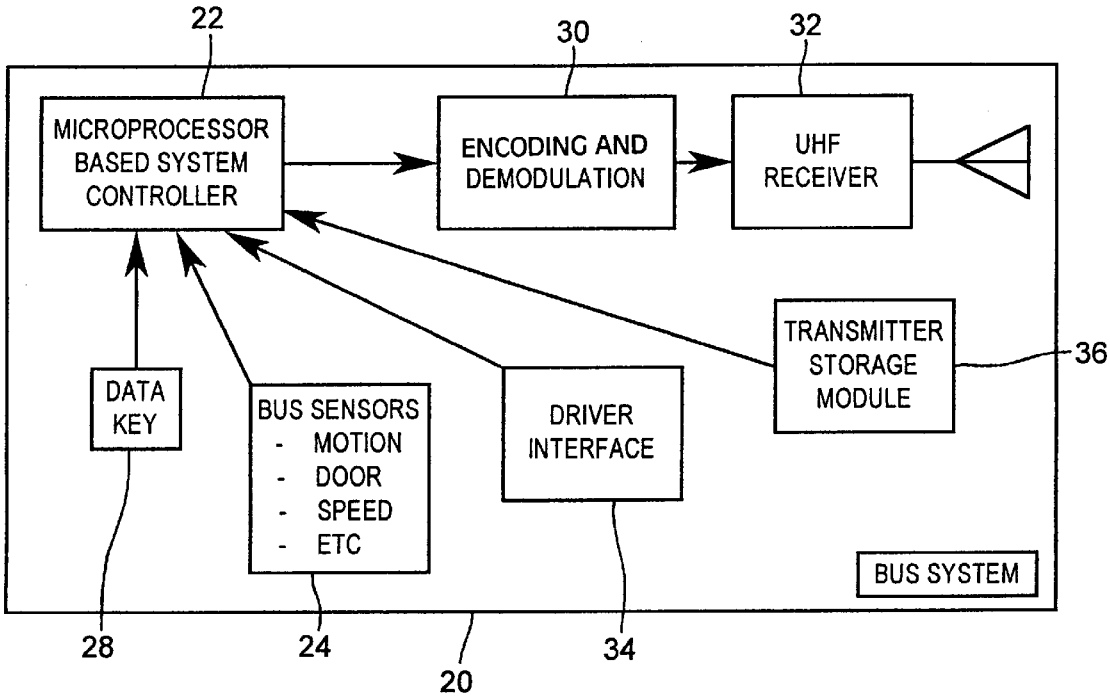
FIG. 1, in a block diagram, illustrates a transmitter subsystem in accordance with a preferred embodiment of the present invention.

Referring to FIG. 1, there is illustrated in a block diagram a transmitter subsystem in accordance with a preferred embodiment of the invention. The transmitter subsystem 20 is installed on a bus, and includes a UHF transmitter 32 for transmitting information from the bus. Typically, the transmitter 32 is a ½ watt UHF transmitter, which has a natural range of about 2 miles.

Figure 3:
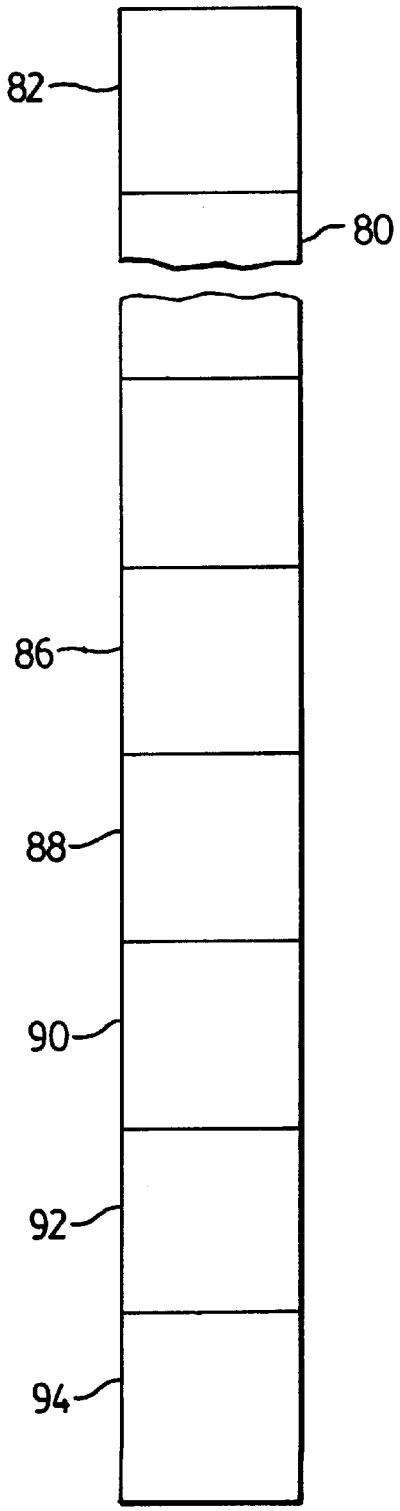

The transmitter subsystem 20 also includes a transmitter microprocessor 22. Referring to FIG. 3, there is illustrated a fixed format data packet 80 that is generated by the microprocessor 22. The data packet 80 includes a plurality of fields ordered according to the format of the data packet 80. One of the fields in the data packet 80 is a route identification field 82 for storing route identification information. This route identification information may be entered by the bus driver or other operator, or, preferably, may be electronically downloaded.

According to a preferred embodiment of the invention, each bus is assigned a pre-defined route. Sometimes a bus will break down, or will be assigned for other purposes and will not be available for its usual routes. If the transmitter subsystem 20 is built into the bus, then it will be inconvenient and labour-intensive to transfer the transmitter subsystem to another bus. Even if the transmitter subsystem is not built into the bus, it will still be inconvenient to move the transmitter subsystem from bus to bus.

According to the preferred embodiment of the invention shown in FIG. 1, the transmitter subsystem 20 includes a data key module 28. A data key having a unique route identification stored thereon is assigned to each route and to the bus allocated to this route. When a bus A is not available for a particular bus route for any reason, the data key for bus A can be inserted into the data key module 28 of the transmitter subsystem 20 of a bus B. Via the data key module 28, the data key configures the microprocessor 22 of the transmitter subsystem 20 of bus B to store the route identification information in the route identification field 82 of the data packet 80. The data key is typically a key with an attached chip that may be used to readily update the transmitter subsystem 20.

In addition to the route identification field 82, the data packet 80 includes a next stop field 92 for storing the next stop along the route, and a time estimate field 94 for storing the estimated time to reach the next stop. The next stop is determined by the transmitter microprocessor 22 from route information stored on a transmitter storage module 36. The time estimate is determined by the transmitter microprocessor 22 based on the current speed and previously measured lengths of time between stops that are stored on the transmitter storage module 36.

In addition to the route identification field 82, the fixed format data packet 80 includes other fields in which the microprocessor 22 can store information regarding the bus. Specifically, information regarding the speed of the bus is storable in a speed field 86 of the fixed format data packet 80, and information regarding the position of the door of the bus is storable in a door field 88 of the fixed format data packet 80. In the transmitter subsystem 20 of FIG. 1, the microprocessor 22 is linked to bus sensors 24 that collect this additional information stored in the data packet 80. The bus sensors 24 include a door sensor that determines when a door of the bus is open or closed, and a speed meter that determines the speed of the bus. Information read by the door sensor and speed meter is stored in the door field 88 and speed field 86 respectively of the fixed format data packet 80.

Optionally, the data packet 80 may also include fields for storing information regarding the identity of the bus, the identity of the bus driver, the number of passengers on the bus, the absolute location of the bus (if, say, a G.P.S. is included onboard), the identity of each passenger and bus status (how many empty seats).

After the microprocessor 22 has stored information regarding the identity, speed, next stop, time to next stop, and door position in the appropriate fields of the data packet 80, the data packet 80 is sent to an encoding and modulation module 30 where the data packet 80 is configured for transmission. The configured data packet 80 is then sent to the transmitter 32 and is transmitted to at least one receiver subsystem.

Figure 2:
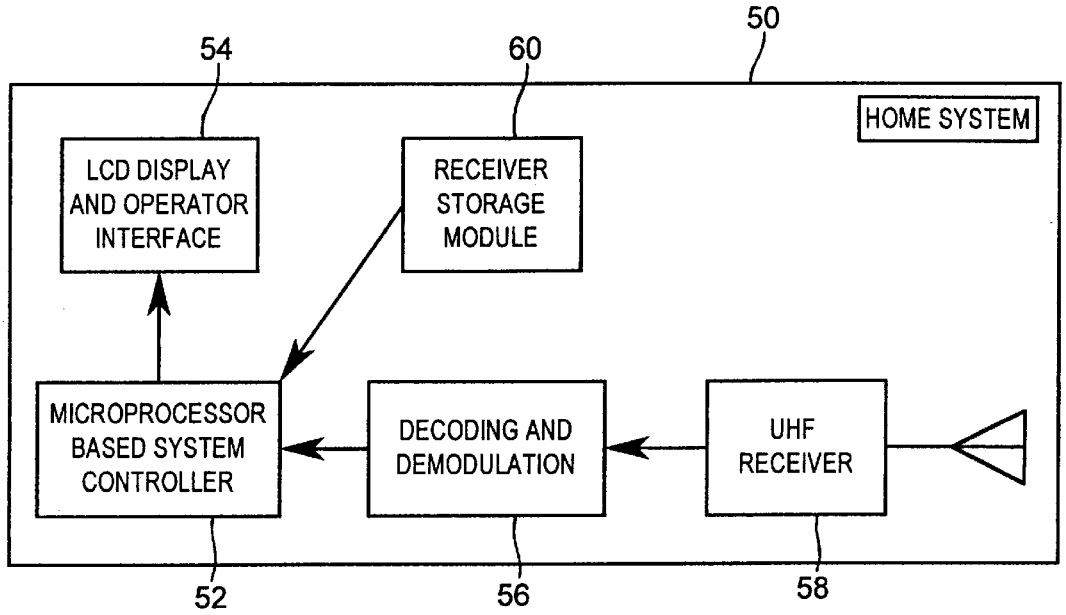
FIG. 2, in a block diagram, illustrates a receiver subsystem for communication with the transmitter subsystem of FIG. 1 in accordance with a preferred embodiment of the present invention; and, FIG. 3, in a block diagram, illustrates a data packet for transmission from the transmitter subsystem of FIG. 1 to the receiver subsystem of FIG. 2.

Referring to FIG. 2, there is illustrated a receiver subsystem 50 in accordance with the preferred embodiment of the invention. The receiver subsystem 50 includes an operator interface module 54 having a liquid crystal display. Using the operator interface module an operator enters route identification information as well as the stop number along that route for each bus that either picks up or drops off a child at the house. This identification information is stored in a storage module 60 of the receiver subsystem 50. The receiver subsystem 50 may listen for a number of different buses, where, for example, children in the house are waiting for different buses from different schools.

The receiver subsystem 50 also includes a UHF receiver 58 for receiving a configured data packet 80 transmitted from the UHF transmitter 32. The configured data packet 80 received by the UHF receiver 58 is sent to a decoding and demodulation module 56. Here, the configured data packet 80 is demodulated to yield the fixed format data packet 80. The data packet 80 is then sent to a receiver microprocessor 52. The receiver microprocessor 52 reads the route identification information from the identification field of the data packet 80. If the route identification information corresponds to the route identification information stored in the storage module 60, then the information from the remaining fields of the data packet 80 is read. The data obtained from the data packet 80 is then converted into an estimated time of arrival and displayed beside the route identification on the liquid crystal display of the operator interface 54.

In operation, the receiver subsystem 50 is continuously listening to the UHF channel used by the transmitter subsystem 20 and receiver subsystem 50, and is constantly decoding and demodulating signals received to look for relevant route identification information. The mere fact that the receiver microprocessor 52 recognizes the route identification means that the bus for that route is close to the receiver 50 due to the relatively short range of the UHF telemetry system. In many cases, and especially for rural routes, this short range may enable the estimated arrival time of the bus to be pinpointed with sufficient accuracy. For example, the bus may consistently arrive at the stop approximately five minutes after the signal is first received by the receiver. The remaining fields are used to refine this estimate as may be required in urban areas where the bus may pass in and out of range many times in following its route and, consequently, the signal may be received long before the bus reaches the stop. The receiver storage module 60 need only store previous time intervals for the bus to travel between the desired stop and each stop in the route that precedes the desired stop. Using the next stop number and the estimated time to the next stop that are stored in fields 92 and 94 of the data packet 80, respectively, the receiver microprocessor can readily calculate the estimated time to the desired stop using the information stored in the receiver storage module 60. These estimates can be further refined using the speed of the bus read from the speed field of the data packet, as well as by using location information if this is provided by a G.P.S. or other locating system mounted the bus. The operator interface 54 may include an automatic notification device, such as a buzzer, that is used to alert the household when the arrival time diminishes to a preselected value.

Information regarding the position of the door of the bus may be useful for a number of reasons. First, how long the bus stops at each stop is an important variable in estimating the arrival time of the bus. The transmitter microprocessor 22 can measure the approximate amount of time spent at each stop by measuring the length of time the door is open, or, more accurately, by measuring the length of time the speed of the bus is equal to zero at a location in which the bus door is open for some of this time. This length of time is then stored, and can be averaged with earlier recorded stop times to provide an estimate of how long the bus will be stopped at each stop preceding the stop near the receiver subsystem 50. These estimates can then be used in adjusting the estimated time of arrival at the next stop and suitably revising the estimate stored in the time estimate field 94 of the data packet 80.

Information regarding the position of the door of the bus may also be used to determine the position of the bus itself. When bus route information, including information about the location of bus stops, is stored on the storage module 60, the microprocessor will be able to determine the location of the bus on the route by counting the number of bus stops and then locating the bus stop on the route at which the bus is stopped. Thus, from counting the number of stops the bus has made, the microprocessor 22 can, from the route information, determine the segment of the route where the bus is currently located. This information is then used to fill the next stop field 92 of the data packet 80.

By storing past estimates in the storage module 60, the receiver microprocessor 52 can improve its estimates by reviewing past estimates to see if estimates are too high or too low on a consistent basis. Specifically, if it appears from the stored estimates that the receiver microprocessor consistently underestimates that amount of time required to reach the stop near the receiver subsystem, the amount of this underestimation is used to upwardly adjust future estimates of the time required to reach the stop.

The transmitter subsystem 20 includes a driver interface 34 that can be used by the driver to notify the various receiver subsystems 50 of relevant information. For example, say the driver is given advance notification that children at a particular stop will not be at that stop on a given day. Then the driver can skip this stop on the route. The next stop and time estimate stored in the next stop field 92 and time estimate field 94 in the data packet 80 need only be updated accordingly by the transmitter microprocessor 22 , and all the receivers will continue to function as described above.

When the bus stops at a stop or passes a stop, this fact is stored in the receiver storage module 60 and displayed on the liquid crystal display 54. This enables one to determine if the children or other passengers dropped off by the bus should be at home, or if the bus has been missed.

The present invention may be embodied in other specific forms without departing from the spirit or essential characteristics thereof. Certain adaptations and modifications of the invention will be obvious to those skilled in the art. Specifically, while much of the description of the present invention relates to the implementation of the invention in a school bus context, it will be apparent to those skilled in the art that the invention can be practiced in any context in which vehicles pick-up and drop-off items or people at different stops along a vehicle route. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An advance notification system for providing information regarding a vehicle that follows a route and stops at a vehicle stop along the route, the system comprising:

a transmitter subsystem for generating and transmitting a signal, the signal including identification information for the route, the transmitter subsystem being mounted on the vehicle; and, a receiver subsystem for receiving the signal transmitted by the transmitter subsystem, the receiver subsystem being located near the vehicle stop, and having a data processing means for processing the signal received by the receiver system to identify the route and to estimate a time period for the vehicle to arrive at the vehicle stop.

2. The advance notification system as defined in claim 1 wherein the receiver subsystem comprises a plurality of receivers distributed along the route for the vehicle, the route having a plurality of stops and each receiver in the plurality of receivers being operable to receive the signal and being located near an associated vehicle stop in the plurality of vehicle stops; and, the data processing means comprises a plurality of data processing units, each receiver in the plurality of receivers having linked thereto an associated data processing unit in the plurality of data processing units, the associated data processing unit being operable to process the signal to identify the route and to estimate the time period for the vehicle to reach the associated vehicle stop.

3. The system as defined in claim 2 wherein the signal comprises a data packet, the data packet having a plurality of fields for storing a plurality of parameters regarding the vehicle, each field in the plurality of fields being operable to store an associated parameter in the plurality of parameters;

the transmitter subsystem has a processor for compiling the data packet before transmission; and for each receiver in the plurality of receivers, the associated data processing unit is operable to read the associated parameter from each field.

4. The system as defined in claim 3 wherein the plurality of fields includes an identification field for storing a route identification parameter for the route.

5. The system as defined in claim 4 wherein the transmitter subsystem includes a transmitter storage means for storing stop information for the route including an order of the stops and an estimated travel time between successive stops in the route; and the plurality of fields includes a next stop field for storing a next stop in the route, and a time estimate field for storing an estimated time for the bus reach the next stop.

6. The system as defined in claim 5 wherein the transmitter subsystem includes a door monitor for determining a door position of the vehicle; and, the transmitter storage means records a stop time when the door is open for each stop; and the processor is operable to store the stop time for each stop in a door field in the plurality of fields.

7. The system as defined in claim 4 wherein each receiver in the plurality of receivers has an associated storage means for storing a selected route identification for a selected route, the associated data processing unit being operable to compare the route information parameter read from the identification field to determine if the route is the selected route.

8. The system as defined in claim 7 wherein the transmitter subsystem includes a speed meter for measuring a time-specific speed of the vehicle, the processor being operable to store the time-specific speed of the vehicle in a speed field in the plurality of fields.

9. The system as defined in claim 8 wherein the associated storage means is operable to store route information for the selected route.

10. The system as defined in claim 9 wherein the route information stored by the associated storage means for each receiver includes, for each stop preceding the associated stop for the receiver, an estimated time interval between the stop and a next stop in the route.

11. The system as defined in claim 10 wherein the transmitter subsystem comprises an interface means for receiving update information entered by a user, the processor being operable to store the update information in an update field in the plurality of fields.

12. The advance notification system as defined in claim 7 wherein each receiver in the plurality of receivers has an associated proximity indicator for indicating when the estimated time period for the vehicle to arrive at the associated stop reaches a selected minimum time period.

13. The advance notification system as defined in claim 7 wherein each receiver in the plurality of receivers has an associated stop indicator for indicating whether the vehicle has stopped at the associated stop.

14. A method for providing information regarding a vehicle that follows a route and stops at a stop along the route, the method comprising:

generating a signal including identification information for the vehicle;

transmitting the signal from a transmitter subsystem on the vehicle;

receiving the signal at a receiver subsystem near the stop on the route; and, processing the signal at the receiver subsystem to identify the vehicle and to estimate a time period for the vehicle to arrive at the stop.

15. The method as defined in claim 14 wherein the route has a plurality of stops;

the receiver subsystem comprises a plurality of receivers distributed along the route for the vehicle, each receiver in the plurality of receivers being located near an associated stop in the plurality of stops; and, the step of receiving the signal comprises receiving the signal at each receiver in the plurality of receivers and processing the signal to identify the vehicle and to estimate a time period for the vehicle to arrive at each stop.

16. The method as defined in claim 15 wherein the signal comprises a data packet;

the step of generating the signal comprises determining a plurality of parameters regarding the vehicle, and storing the plurality of parameters in the data packet, the data packet having a plurality of fields for storing the plurality of parameters, each field in the plurality of fields being operable to store an associated parameter in the plurality of parameters; and, the step of processing the signal at each receiver comprises reading at least one parameter from the plurality of fields.

17. The method as defined in claim 16 wherein the plurality of fields includes a route identification field for storing a route identification parameter for the vehicle, the method further comprising for each receiver in the plurality of receivers, storing the route identification parameter on an associated receiver storage means for the receiver, when a signal is received by a receiver, comparing the route identification parameter stored in the data packet with the route identification parameter stored on the associated receiver storage means, and if the route identification parameter stored in the data packet matches the route identification parameter stored on the receiver storage means, then reading other parameters from the plurality of parameters stored on the data packet.

18. The method as defined in claim 17 wherein the plurality of parameters determined include a next stop in the route and an estimated time for the bus to reach the next stop in the route; and, the plurality of fields includes a next stop field for storing the next stop in the route and a time estimate field for storing the estimated time for the bus to reach the next stop in the route.

19. The method as defined in claim 18 wherein the plurality of parameters regarding the vehicle comprises a door position monitor.

20. The method as defined in claim 18 further comprising, for each receiver in the plurality of receivers, storing, for each stop preceding the associated stop for the receiver, an associated time interval for the vehicle to travel from the preceding stop to the next stop.

21. The method as defined in claim 20 wherein for each receiver in the plurality of receivers and for each stop preceding the associated stop for the receiver, the associated time interval for the vehicle to travel from the preceding stop to the next stop is updated each time the vehicle travels the route.

22. The method as defined in claim 15 wherein each receiver in the plurality of receivers provides a proximity warning when the estimated time period for the vehicle to arrive at the associated stop reaches a selected minimum time period.

23. The method as defined in claim 15 wherein each receiver in the plurality of receivers provides a binary stop indicator regarding whether the vehicle has stopped at the associated stop.

* * * * *